US005494570A

United States Patent [19]

Nongbri et al.

[11] Patent Number: 5,494,570

[45] Date of Patent: Feb. 27, 1996

[54] EBULLATED BED PROCESS

[75] Inventors: Govanon Nongbri, Port Neches; Gerald V. Nelson, Nederland; David E. Self, Port Neches; Glenn A. Clausen, Nederland, all of Tex.

[73] Assignee: Texaco Inc., White Plains, N.Y.

[21] Appl. No.: 264,881

[22] Filed: Jun. 24, 1994

[51] Int. Cl.[6] ..... C10G 47/00

[52] U.S. Cl. ..... 208/108; 208/111; 208/153; 208/112

[58] Field of Search ..... 208/108, 111, 208/112, 153

[56] References Cited

U.S. PATENT DOCUMENTS

| | | | |
|---|---|---|---|
| Re. 25,770 | 4/1965 | Johanson | 208/10 |
| 3,553,105 | 1/1971 | Layng et al. | 208/213 |
| 4,427,535 | 1/1984 | Nongbri et al. | 208/112 |
| 5,156,733 | 10/1992 | Nongbri et al. | 208/108 |

*Primary Examiner*—Helane Myers

*Attorney, Agent, or Firm*—James L. Bailey; Kenneth R. Priem; Richard A. Morgan

[57] ABSTRACT

An improvement has been discovered in an ebullated bed process. A residual hydrocarbon oil feedstock is hydrocracked to yield a product oil. The amount of sediment in the product oil is controlled by adjusting hydrogen partial pressure according to an algorithm. A change in temperature and residence time is avoided.

5 Claims, 2 Drawing Sheets

EBULLATED BED PROCESS

BACKGROUND OF THE INVENTION

1. Field of the Invention

The invention relates to an ebullated bed process for converting a residual hydrocarbon oil to a product oil comprising an increased amount of sediment. More particularly, the invention relates to selecting a hydrogen partial pressure to achieve a selected amount of sediment.

2. Description of Other Related Methods in the Field

The ebullated bed process comprises the passing of concurrently flowing streams of liquids, or slurries of liquids and solids, and gas through a vertically elongated fluidized catalyst bed. The catalyst is fluidized and completely mixed by the upwardly flowing liquid streams. The ebullated bed process has found commercial application in the upgrading of heavy liquid hydrocarbons and converting coal to synthetic oils.

The process is generally described in U.S. Pat. No. 25,770 to Johanson incorporated herein by reference. A mixture of hydrocarbon liquid and hydrogen is passed upwardly through a bed of catalyst particles at a rate such that the particles are forced into random motion as the liquid and gas pass upwardly through the bed. The catalyst bed motion is controlled by a recycle liquid flow so that at steady state, the bulk of the catalyst does not rise above a definable level in the reactor. Vapors along with the liquid which is being hydrogenated pass through that upper level of catalyst particles into a substantially catalyst free zone and are removed from the upper portion of the reactor.

U.S. Pat. No. 5,156,733 to G. Nongbri et al. discloses a method of controlling sediment in an ebullated bed process. In switching from one sediment yielding feedstock to another, transient carbon release from the catalyst is controlled.

U.S. Pat. No. 4,427,535 to G. Nongbri et al. discloses an ebullated bed process for the hydroconversion of special petroleum feedstocks. Reactor temperature and hydrogen partial pressure are shown to be related to the conversion of 975° F.$^+$ feedstock.

U.S. Pat. No. 3,553,105 to E. T. Layng et al. discloses an ebullated bed process for removing sulfur from a liquid hydrocarbon feedstock. Process operating conditions including feedstock characterization, temperature, pressure, catalyst age and activity are adjusted to achieve desulfurization.

BRIEF DESCRIPTION OF THE INVENTION

The invention is an improvement in an ebullated bed process for hydrocracking a residual hydrocarbon oil with a hydrogen-containing gas at elevated temperature and hydrogen partial pressure in an ebullated bed of solid particulate catalyst. The product oil comprises an amount of sediment.

In the improvement, the conversion of residual hydrocarbon oil to product oil is calculated according to the formula:

$$\text{conversion} = \frac{\text{volume } 1000^\circ\text{ F.}^+\text{ hydrocarbon in feed-volume } 1000^\circ\text{ F.}^+\text{ hydrocarbon in product}}{\text{volume } 1000^\circ\text{ F.}^+\text{ hydrocarbon in feed}} \times 100$$

A target amount of sediment is selected. The hydrogen partial pressure is adjusted to achieve the target amount of sediment as a function of conversion and sediment according to the formula:

$$P_{H_2} = f(\text{conversion}^3 + \ln \text{sed}).$$

In a specific embodiment of the invention the hydrogen partial pressure is adjusted to achieve the target amount of sediment according to the formula:

$$P_{H_2} = -\left[\frac{a' + b'(\text{conversion})^{1.5}}{c'}\right]^2 + \frac{\ln \text{sed}}{c'}$$

wherein:

ln sed=natural logarithm of the target amount of sediment, weight %

$P_{H_2}$=hydrogen partial pressure, psia a'=2.6945 b'=0.0009725 c'=−0.0057844

The invention is useful for maintaining a consistent, acceptable amount of sediment in product oil, termed the target amount, by manipulating a single, easy to adjust process variable. A uniform product oil quality is thereby achieved.

DETAILED DESCRIPTION OF THE INVENTION

Feedstocks for the ebullated bed process include residual hydrocarbon oils such as petroleum atmospheric distillation bottoms, vacuum distillation bottoms, deasphalter bottoms, shale oil, shale oil residues, tar sand oils, bitumen oils, coal derived hydrocarbon oils, hydrocarbon residue oils, lubricating oil extracts and mixtures thereof. Feedstocks are in general the bottoms product of atmospheric distillation or vacuum distillation to produce an initial boiling point of 900° F. (482° C.) or higher, typically 950° F. (510° C.) or higher.

Residual oil feedstocks are catalytically hydrocracked in the ebullated bed process to produce lighter fractions which are intermediates for processing to liquid fuels and gases. The more severe the conditions under which the residual oil feedstock is treated, the greater the conversion to lighter fractions. It is typical in the art to base conversion on the volume percent reduction in the portion of the feedstock having a boiling point of 1000° F. and higher. Hydrocarbons boiling at 1000° F. and higher have lesser fuel value, whereas lighter fractions have greater fuel value.

A coproduct of the ebullated bed hydrocracking process is sediment. Sediment is one of the catalytic hydroconversion products of a residual hydrocarbon oil feedstock. The more severe the conditions under which the residual oil feedstock is treated, the greater the conversion to sediment. Sediment comprises material which is solid, or insoluble in a liquid oil. Sediment is measured on samples having a viscosity of less than 130 cSt @ 80° C. by test methods such as ASTM D-4870 or Institute de Petrole IP-375 and the Shell Hot Filtration Test. Sediment is measured on samples having a viscosity of greater than 130 cSt @ 80° C. by toluene extraction according to Institute de Petrole IP-143. Though there is some variation among these tests, each is a commercially used analytical method which measures sediment in residual hydrocarbon oil. The amount of sediment quantified by each test is sufficiently similar to make them equivalent for purposes of this invention.

Figure 1:
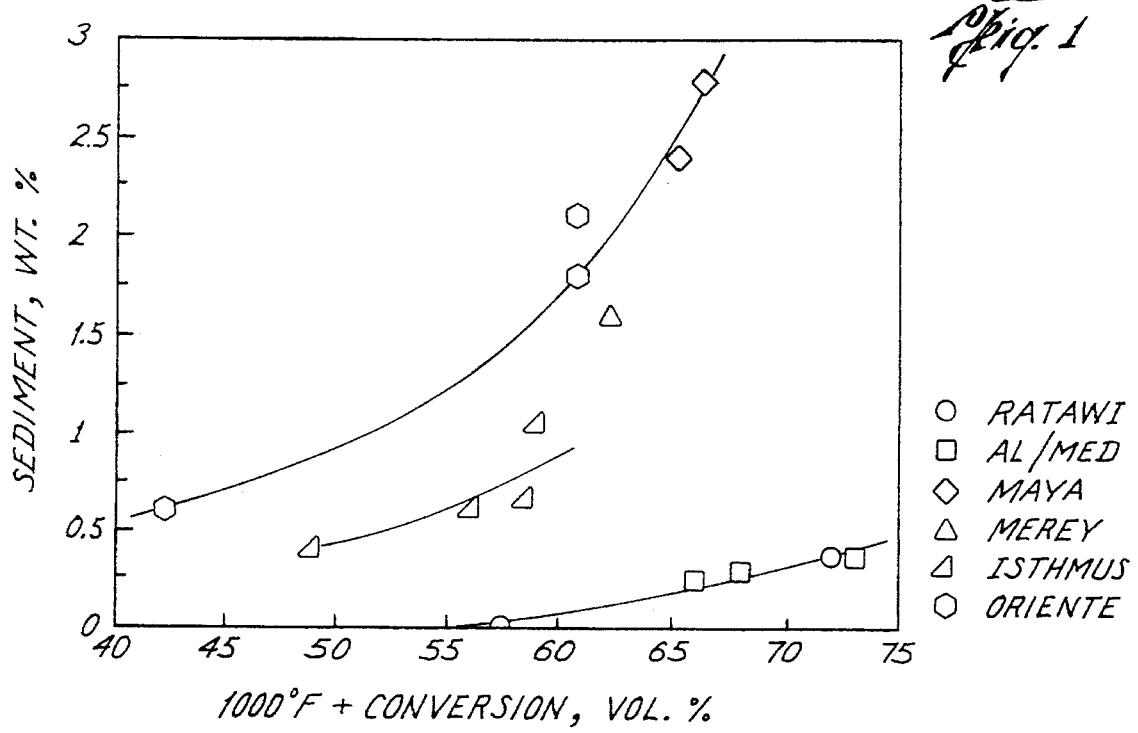
FIG. 1 is a plot of data of the conversion of residual hydrocarbon oil feedstocks versus sediment in product oil in an ebullated bed process.

Reference is made to FIG. 1 which graphically demonstrates the relationship between conversion and sediment yield from residual oil feedstocks. Ebullated bed process feedstocks were fractionated from six crude petroleums. Each one was subjected to ebullated bed hydroconversion in a pilot plant at severities to cause the conversion of the 1000° F.$^+$ (538° C.$^+$) portion of the feedstock. Samples of the conversion product were taken and analyzed for sediment. The data from the analyses are plotted in FIG. 1.

Sediment is a coproduct of the ebullated bed process. As conversion of a feedstock is increased, the amount of sediment produced is increased. Different feedstocks produce different amounts of sediment. Three curves are drawn in FIG. 1. The upper curve describes relatively high sediment yielding feedstocks. The middle curve describes relatively medium sediment yielding feedstocks. The lower curve describes relatively low sediment yielding feedstocks. A blend of two feedstocks yields an amount of sediment intermediate between the two feedstocks. The same occurs for multiple feedstock combinations.

Figure 2:
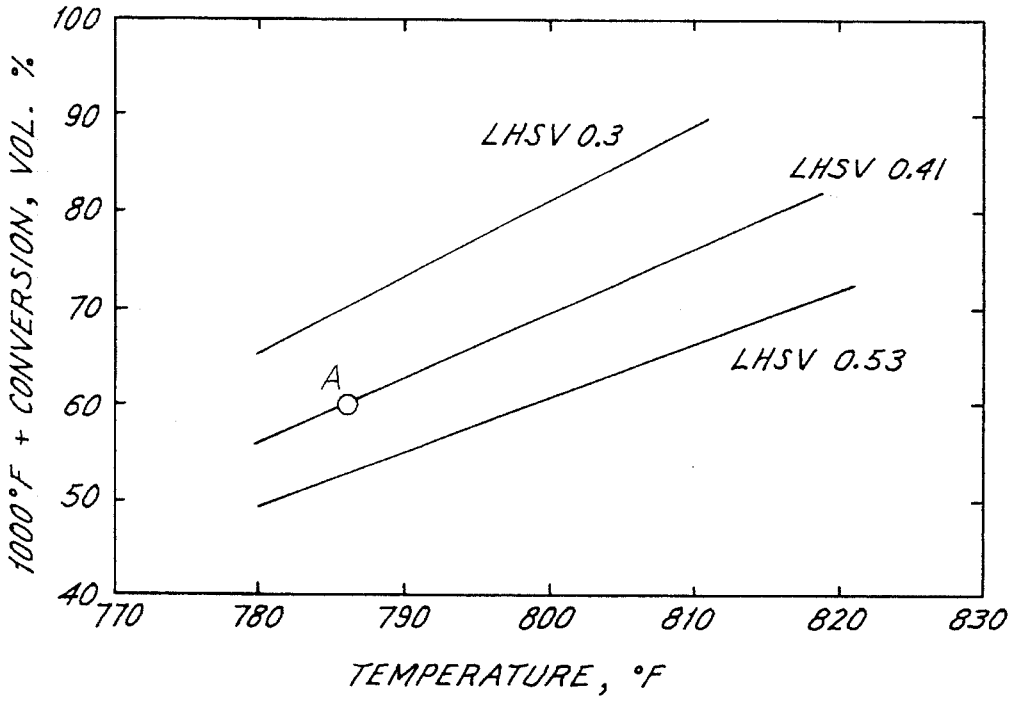
FIG. 2 is a graphical representation of the conversion of a residual hydrocarbon oil feedstock versus temperature at constant liquid hourly space velocity in an ebullated bed process.

Attention is drawn to FIG. 2. Severity in hydroconversion processing conditions is described by temperature, pressure and residence time of the feedstock. Residence time is the liquid hourly space velocity (LHSV) of the feedstock in contact with the ebullated bed of catalyst. FIG. 2 is a graphical depiction of the relationship between severity and conversion. In FIG. 2, 1000° F.$^+$ (538° C.$^+$) conversion is plotted versus temperature at three space velocities, at constant pressure. FIG. 2 shows that as hydroprocessing temperature is increased, conversion increases at constant space velocity and pressure. FIG. 2 was constructed by plotting pilot plant data.

Figure 3:
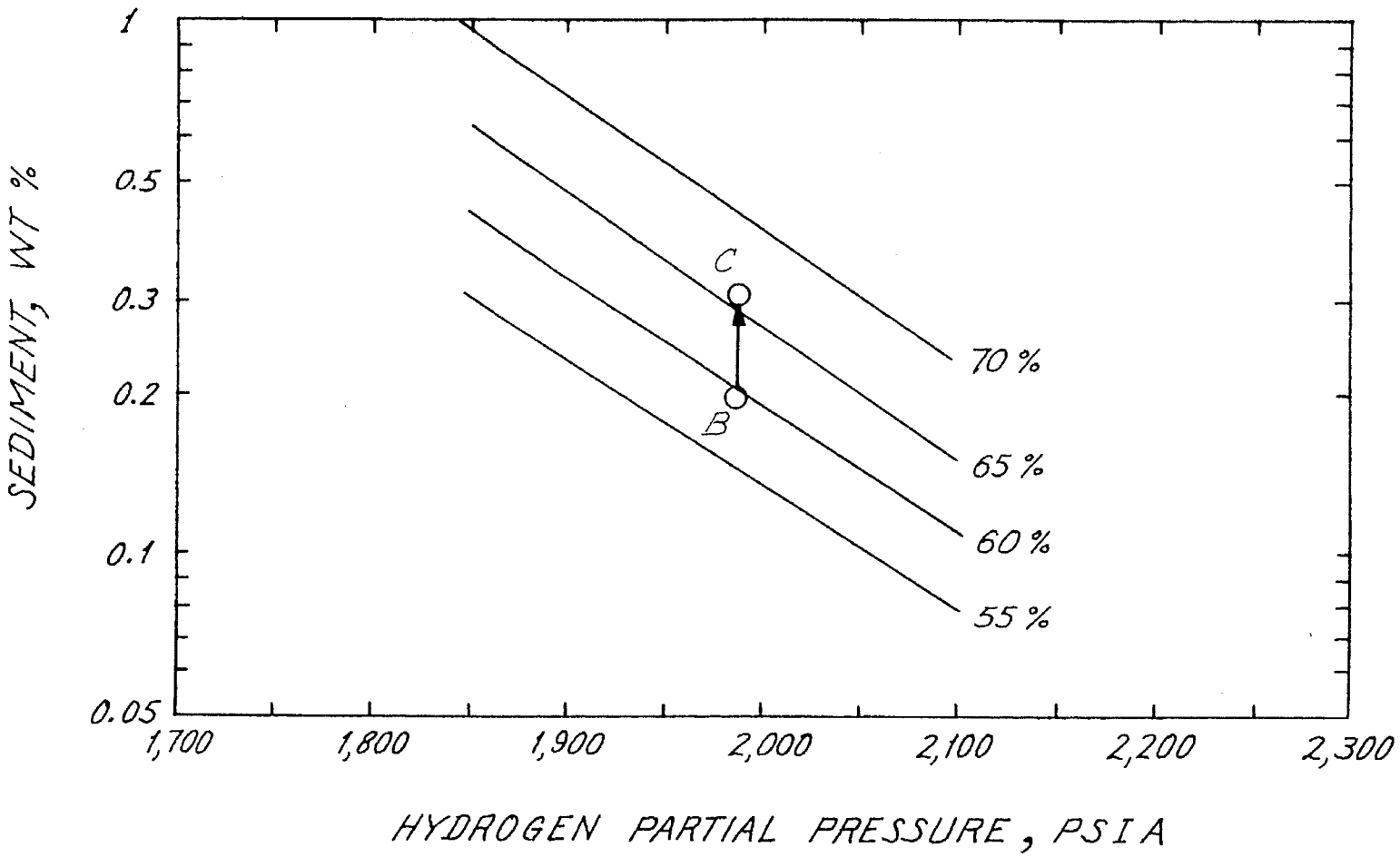
FIG. 3 is a graphical representation of the sediment in product oil versus hydrogen partial pressure at constant conversion in an ebullated bed process.

Attention is drawn to FIG. 3. FIG. 3 is a graphical description of the relationship between sediment in ebullated bed product as a function of hydrogen partial pressure, at constant conversion. Pilot plant runs were conducted for different feedstocks. Sediment amounts were correlated with conversions at constant pressures. The results are plotted to produce FIG. 3.

A test run on a given feedstock and catalyst combination is conducted at two sets of hydrogen partial pressure and two levels of conversion at one of the pressure levels to determine the constants of the equation. This can be done as follows:

$$c'=[\ln(s_1)-\ln(S_2)]/[P_1-P_2]$$

Where:

$P_1$=Outlet hydrogen partial pressure, psia at condition 1, $P_2$=Outlet hydrogen partial pressure, psia at condition 2, $s_1$=Sediment, wt % at condition 1, and $s_2$=Sediment, wt % at condition 2

$A1=\ln(s_1)-c'P_1$ $A1=\ln(s_3)-c'P_3$

Where:

A1, A2 are intermediate calculation constants $P_3$=Outlet hydrogen partial pressure, psia at condition 3, $s_3$=Sediment, wt % at condition 3

$b'=[(A1)^{1/2}-(A2)^{1/2}/[C_1^{1.5}-C_3^{1.5}]$ $a'=(A1)^{1/2}-b'[C_1^{1.5}]$

Where:

$C_1$=Conversion, vol % at condition 1, and $C_3$=Conversion, vol % at condition 3.

From the existing run, feed rate, temperature, partial pressure and conversion are known and also the sediment. Plot the conversion level in FIG. 2 and draw a parallel line to determine the temperature needed for the second higher conversion. Run the unit at this higher temperature and get a sediment number. Bring the temperature back to the original temperature and then increase the partial pressure by reducing recycle gas and increasing make up hydrogen gas. Obtain sediment results at each condition. For example, tabulate the results as shown below and carry out the calculations as indicated.

| | Condition 1 | Condition 2 | Condition 3 |
|---|---|---|---|
| Conversion, % | 55 | 55 | 60 |
| $H_2$ partial pressure, psia | 1850 | 2050 | 1850 |
| Sediment, wt % | 0.318 | 0.10 | 0.449 |
| Calculation of c' | | | |
| c' = [ln(0.318) − ln(0.10)]/[1850–2050] = −0.00579844 | | | |
| Calculations of a' and b'. | | | |
| A1 = ln(0.318) + 0.00579 * 1850 = 9.566 | | | |
| A2 = ln(0.449) + 0.00579 * 1850 = 9.9108 | | | |
| $[A1]^{1/2}$ = a' + $[55]^{1.5}$b' | | | |
| $[A2]^{1/2}$ = a' + $[60]^{1.5}$b' | | | |
| b' = 0.0009725 and a' = 2.6945 | | | |

Once the refiner obtains the values of the constants for his operation, then he can use the constants to set up the control model for his operation. The invention is particularly adapted for computer control of a process.

The invention is explained by way of Example.

EXAMPLE

In an ebullated process as severity of hydroprocessing is increased, the amount of sediment in the liquid product increases. At conversions above 60 vol %, the sediment production is higher. In a two-stage pilot unit, sediment in amounts of 0.6 wt % and above causes excess fouling. In a single-stage pilot unit, excess fouling occurs at sediment amounts of 0.8 wt % and above. Commercial units are run to maintain a sediment concentration of 0.2 wt % to 0.3 wt % to produce liquid fuel products of uniform quality.

By way of example, the conversion of an Arabian resid is 60 vol % and the sediment in the fractionator bottoms is 0.2 wt %. The operating conditions are as follows:

| | |
|---|---|
| Temperature, °F. | 786 |
| LHSV, v/hr/v | 0.41 |
| Make up hydrogen rate, SCF/B | 1800 |
| Make-up hydrogen purity, vol % | 99 |
| Recycle gas rate, SCF/B | 6000 |
| Recycle hydrogen, vol % | 70.6 |

-continued

| | |
|---|---|
| Reactor total pressure, psia | 2800 |
| Calculated values: | |
| Hydrogen rate, SCF/B (make up + recycle gas) | 7800 |
| Estimated hydrocarbon vapor, SCF/B | 200 |
| Total gas rate, SCF/B | 8000 |
| Total purity at inlet, vol % | 75.23 |
| Hydrogen inlet pressure, psia | 2106 |
| Assuming 120 psia of hydrogen partial pressure loss in the reactor (consumption) | |
| Hydrogen outlet pressure, psia | 1986 |

This condition is shown as point A in FIG. 2 and as point B in FIG. 3.

The feedstock mixture changes and as a result sediment in the liquid product is about 0.3 wt %. Other operating conditions remain the same, including conversion at 60 vol %. This is shown as point C in FIG. 3. There are several ways to return to 0.2 wt % sediment.

FIG. 3 shows one of the ways is to reduce conversion. Conversion is reduced either by reducing temperature or by increasing liquid space velocity (LHSV). Reducing temperature reduces the yield of distillate products and is not preferred. Reducing conversion by increasing space velocity may not always be possible. FIG. 3 shows that sediment can be reduced by increasing the outlet hydrogen partial pressure from 1986 psia to about 2060 psia. The equation that predicts the sediment level with respect to outlet hydrogen partial pressure and conversion is:

$$\ln sed = [a + b(\text{conversion})^{1.5}]^2 + c(P_{H_2})$$

where:

$P_{H_2}$=hydrogen partial pressure, psia ln sed =natural logarithm of the target amount of sediment, wt % a=2.6945 b=0.0009725 c=−0.0057844

Once the required partial pressure is known, one can calculate the amount of make-up hydrogen needed. For this example, the outlet partial pressure to maintain sediment at 0.2 wt % is 2060 psia. Assuming the hydrogen partial pressure at the reactor inlet is 120 psia higher, the inlet hydrogen partial pressure is 2180 psia. The hydrogen purity is 77.86 vol % hydrogen. Assuming the amount of vaporized hydrocarbon to be 200 SCF/B, the purity of the recycle gas and make-up hydrogen is 79.85 vol %. The make-up rate must be raised from 1800 to 2541 SCF/B and the recycle gas rate reduced from 6000 to 5259 SCF/B.

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A process comprising hydrocracking a residual hydrocarbon oil with a hydrogen-containing gas at a reaction temperature and a hydrogen partial pressure in an ebullated bed of particulate solid catalyst, to yield a product oil comprising sediment, wherein the improvement comprises:

i. calculating a conversion according to the equation:

conversion =

-continued $$\frac{\text{volume } 1000^\circ\text{ F.}^+\text{ hydrocarbon in feed-volume } 1000^\circ\text{ F.}^+\text{ hydrocarbon in product}}{\text{volume } 1000^\circ\text{ F.}^+\text{ hydrocarbon in feed}} \times 100$$

ii. selecting a target amount of sediment, and iii. selecting a hydrogen partial pressure to according to the equation:

wherein:

$P_{H_2}$=f(conversion$^3$+ln sed)

$P_{H_2}$=hydrogen partial pressure, psia ln sed=natural logarithm of the target amount of sediment, wt %.

iv. hydrocracking at the selected hydrogen partial pressure $P_{H_2}$, thereby achieving the target amount of sediment at the calculated conversion.

2. A process comprising hydrocracking in an ebullated bed of particulate solid catalyst for conversion of a 1000° F. residual hydrocarbon oil with a hydrogen-containing gas at a reaction temperature and a hydrogen partial pressure to yield a product oil having a sediment concentration, said conversion calculated according to the formula:

conversion =

$$\frac{\text{volume } 1000^\circ\text{ F.}^+\text{ hydrocarbon in feed-volume } 1000^\circ\text{ F.}^+\text{ hydrocarbon in product}}{\text{volume } 1000^\circ\text{ F.}^+\text{ hydrocarbon in feed}} \times 100$$

the process comprising:

i. selecting a first operating point, defined by a first hydrogen partial pressure ($P_1$), a first 1000° F.$^+$ hydrocarbon oil conversion ($C_1$) and a first product oil sediment concentration ($s_1$) and hydrocracking at this first operating point, ii. hydrocracking at a second operating point, defined by a second hydrogen partial pressure ($P_2$), and a second product oil sediment concentration ($s_2$), iii. selecting a third operating point, defined by a third hydrogen partial pressure ($P_3$), a third 1000° F.$^+$ hydrocarbon oil conversion ($C_3$) and a third product oil sediment concentration ($s_3$), said third hydrogen partial pressure ($P_3$) selected according to the equation:

$$P_3 = -\left[\frac{a' + b'(C_3)^{1.5}}{c'}\right]^2 + \frac{\ln s_3}{c'}$$

wherein:

$$c' = \ln s_1 - \ln s_2/(P_1 - P_2)$$

$$a' = (\ln s_1 - c'P_1)^{0.5} - b'C_1^{1.5}$$

$$b' = \frac{(\ln s_1 - c'P_1)^{0.5} - (\ln s_3 - c'P_3)^{0.5}}{(C_1^{1.5} - C_3^{1.5})}$$

and hydrocracking at this third operating point.

3. The process of claim 1 wherein said third product oil sediment concentration ($s_3$) is selected approximately equal to said first product oil sediment concentration ($s_1$).

4. The process of claim 1 wherein said reaction temperature is constant.

5. An ebullated bed process for a residual hydrocarbon oil with a hydrogen-containing gas at a reaction temperature and a hydrogen partial pressure in the presence of a bed of particulate solid catalyst, to yield a product oil comprising sediment, wherein the improvement comprises:

i. calculating a conversion according to the equation:

$$\text{conversion} = \frac{\text{volume } 1000^\circ \text{ F.}^+ \text{ hydrocarbon in feed-volume } 1000^\circ \text{ F.}^+ \text{ hydrocarbon in product}}{\text{volume } 1000^\circ \text{ F.}^+ \text{ hydrocarbon in feed}} \times 100$$

ii. selecting a target amount of sediment, and iii. selecting a hydrogen partial pressure to achieve the target amount of sediment according to the equation:

$$P_{H_2} = -\left[\frac{a' + b'(\text{conversion})^{1.5}}{c'}\right]^2 + \frac{\ln \text{sed}}{c'}$$

wherein:

$P_{H_2}$=hydrogen partial pressure, psia ln sed =natural logarithm of the target amount of sediment, wt % a'=2.6945 b'=0.0009725 c'=−0.0057844.

iv. hydrocracking at the selected hydrogen partial pressure $P_{H_2}$, thereby achieving the selected target amount of sediment at the calculated conversion.

* * * * *